United States Patent [19]

Pihlajamäki et al.

[11] 4,384,921

[45] May 24, 1983

[54] ALKALINE SULFITE PULPING PROCESS WITH SODIUM ALUMINATE AND ANTHRAQUINONE

[75] Inventors: Soile H. Pihlajamäki, Sunila; Nils-Erik Virkola, Helsinki, both of Finland

[73] Assignee: Osakeyhtio A. Ahlstrom, Noormarkku, Finland

[21] Appl. No.: 260,325

[22] Filed: May 4, 1981

[30] Foreign Application Priority Data

May 21, 1980 [FI] Finland ..... 801628

[51] Int. Cl.[3] ..... D21C 3/20

[52] U.S. Cl. ..... 162/72; 162/79; 162/83

[58] Field of Search ..... 162/83, 72, 79, 90

[56] References Cited

U.S. PATENT DOCUMENTS

| | | | |
|---|---|---|---|
| 1,935,580 | 11/1933 | Richter | 162/80 |
| 2,601,110 | 6/1952 | Fisher et al. | 162/79 |
| 4,213,821 | 7/1980 | Vanderhoek et al. | 162/72 |
| 4,218,284 | 8/1980 | Hultman et al. | 162/79 |

FOREIGN PATENT DOCUMENTS 847218 7/1970 Canada .

OTHER PUBLICATIONS

Svensk Papperstidning, 73 (1970) 5, pp. 122–133.
Paperi ja Puu, (61/1979), pp. 685–700.

*Primary Examiner*—Steve Alvo
*Attorney, Agent, or Firm*—Bucknam and Archer

[57] ABSTRACT

An alkaline sulfite pulping process in which the lignocellulosic material is cooked in a solution containing sodium sulfite is provided. Sodium aluminate is used as a buffering agent. As a result of this, the stability of the pH of the cook and the properties of the pulp are improved. The amount of sodium aluminate as NaOH is from 2% to 8% based on the dry weight of the chips. The pulping process is carried out with the addition of a small dosage of anthraquinone, to produce chemically defibered pulps.

2 Claims, 4 Drawing Figures

ALKALINE SULFITE PULPING PROCESS WITH SODIUM ALUMINATE AND ANTHRAQUINONE

The present invention relates to alkaline sulfite pulping which yields pulp with excellent strength properties, and particularly to a pulping process in which sodium sulfite is used as the base cooking liquor, sodium aluminate as the buffering agent and, in addition, small amounts of anthraquinone or corresponding compounds.

When pulping cellulosic raw materials, the aim is to convert the lignin of wood, or parts of it, through chemical reactions into a form that dissolves in the cooking liquor. The dissolution of the components of wood is not selective, but, in addition to the dissolvement of lignin during the delignification, also carbohydrate degrades partially. The quality properties of paper pulp depend mostly on the quality and amount of hemicelluloses it contains.

Nowadays, when the society demands less and less pollutive mills, the benefits of the sulfate method should be weighed anew. In spite of many attempts, it has not been possible to remove the principal disadvantage of the process, namely the unpleasant odour and the toxicity caused by organic and inorganic sulfide compounds.

For a decade, efforts have been made to develop alkaline sulfite cooking processes which would yield pulps with at least the same strength properties such as those of sulfate pulp without using sulfide as the cooking liquor. At the same time, the aim has been to improve the yield. In addition to eliminating environmental problems, an ideal pulping process should have an efficient and much simpler chemical recovery system than the present processes, without affecting safety.

In an alkaline sulfite method, the material is cooked in an alkaline liquor free form sulfide while the temperature varies in the range of 140°–210° C. and the starting-pH of cold liquor between 10 and 13.5. At the cooking temperature the pH is somewhat lower than at 20° C. Of all the cooking factors of the alkaline sulfite cooking, the influence of pH upon the process and the pulp properties is crucial. For instance, according to the Finnish Pat. No. 53 331, the tear resistance, flexural resistance and the inner viscosity of the pulp tend to rise in hot pH values higher than pH 6. The same patent further discloses that the tensile strength and the bursting strength reach the maximum in hot pH 8, but the tear resistance does not reach the maximum in the covered area (max. hot pH 9.5).

The pH of the pure sodium sulfite mixture ($Na_2SO_3$) is about 11.0 and it cannot act as a buffering agent. It is known that by adding sodium sulfide ($Na_2S$), sodium carbonate ($Na_2CO_3$) or sodium hydroxide (NaOH), into the cooking liquor to act as buffering chemicals, the decrease in pH during the alkaline sulfite cooking can be reduced.

The U.S. Pat. No. 1,378,441 "Method for alkaline sulfite digestion," patented already in the 1960's, introduced a method in which sodium sulfide ($Na_2S$) is used as a buffering agent and the optimum dosage in regard with the pulp properties is 28% $Na_2SO_3$ and 12% $Na_2S$ as NaOH based on oven dry wood (Svensk Papperstidning 73 (1970) 5, pages 122 to 133). This method yields pulps with the same strength properties than those of sulfite pulp. The amount of reject is, however, quadruplicate compared to corresponding sulfate cooking. The use of sulfide as cooking liquor introduces pollutive sulphur compounds as in the sulfate process; it has been found that for some reason the unpleasant odour of sulfide increases when using sodium sulfite ($Na_2SO_3$). The dosage of chemicals in the digestion is doubled compared to sulfate cooking, thus a very efficient washing and recovery system is necessary.

The process of alkaline sulfite pulping, while sodium hydroxide (NaOH) is acting as a pH buffer of the sodium sulfite liquid, has been demonstrated in the Canadian Pat. No. 847,218. The strength properties of these pulps are, like in the former case, about the same as with sulfate, and, in addition, the process is odourless. The disadvantages of this method are:

- large consumption of chemical in the cooking (over 10% NaOH of wood more than in sulfate cooking), although the consumption can be reduced by adding anthraquinone.
- difficult regeneration of chemicals
- low delignification degree
- low yield, especially with softwood The Finnish patent application No. 77 1744 describes the so called neutral sulfite method with sodium carbonate $Na_2CO_3$) as a buffer chemical in the sodium sulfite pulping liquor. The cold pH of the liquor is $<10$. To obtain fiberizing pulps the process requires an addition of anthraquinone (Paperi ja Puu 61/1979, pages 685 to 700). It has been proved that this process yields pulps that have the same strength properties as sulfate pulp, excluding tear resistance. Furthermore, during beating the tear resistance reduces faster than that of sulfate pulp.

Figure 1:
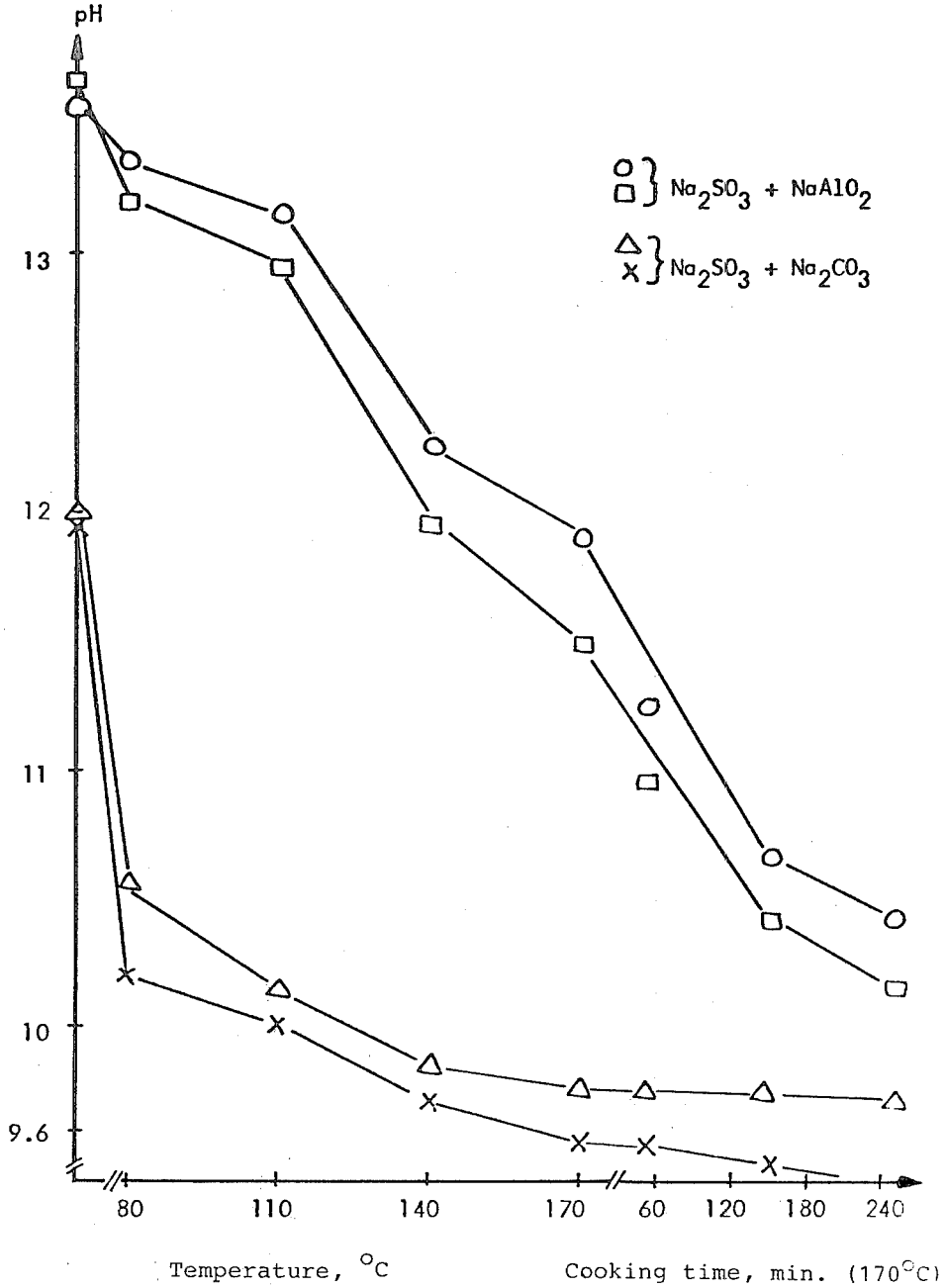
FIG. 1 compares the holding of the pH with sodium aluminate to sodium carbonate.
Figure 2:
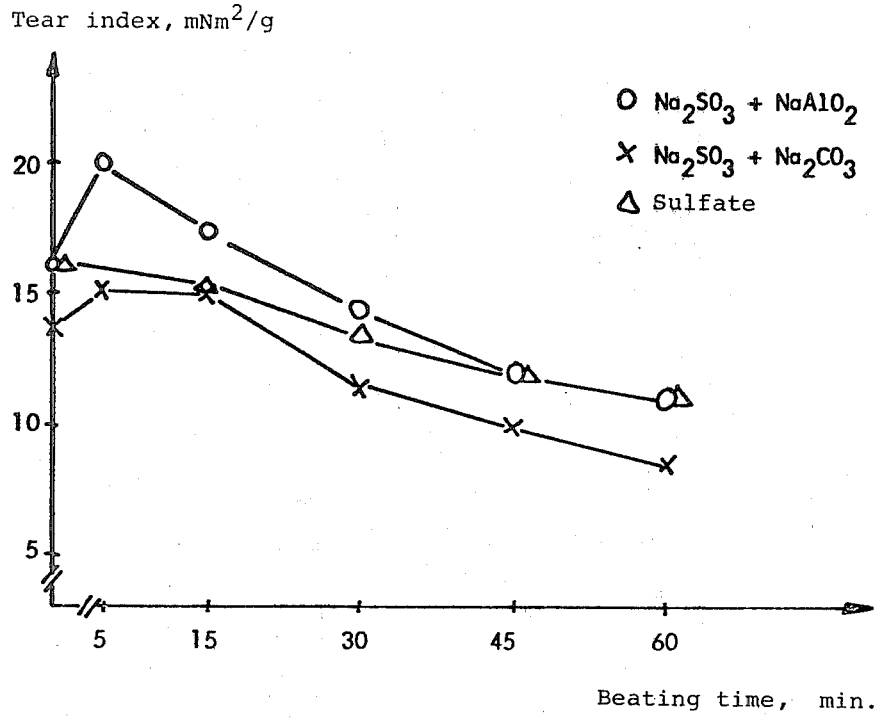
FIGS. 2, 3, and 4 show the results of examples 1, 2, and 3.
Figure 3:
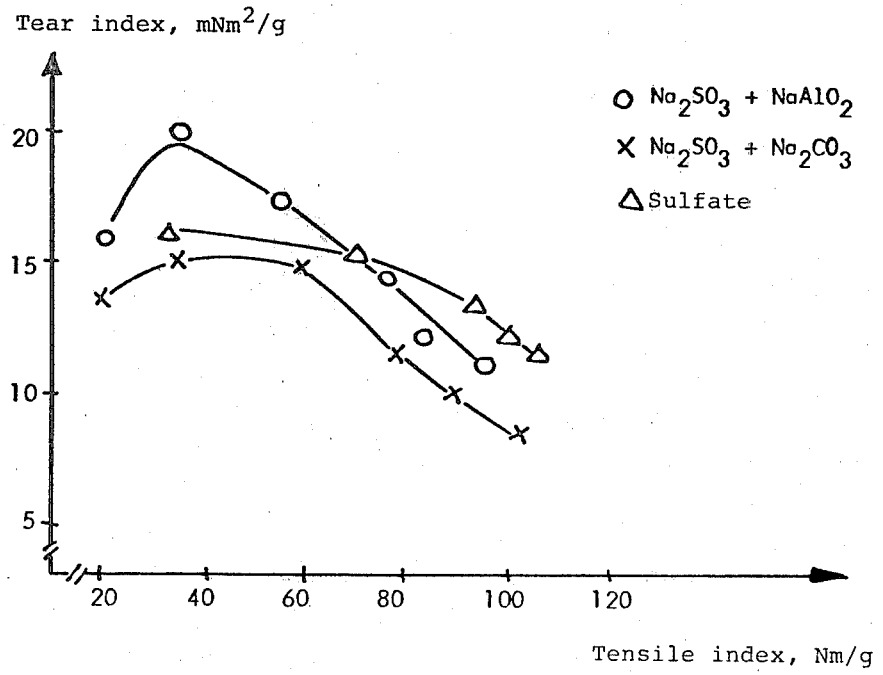
Figure 4:
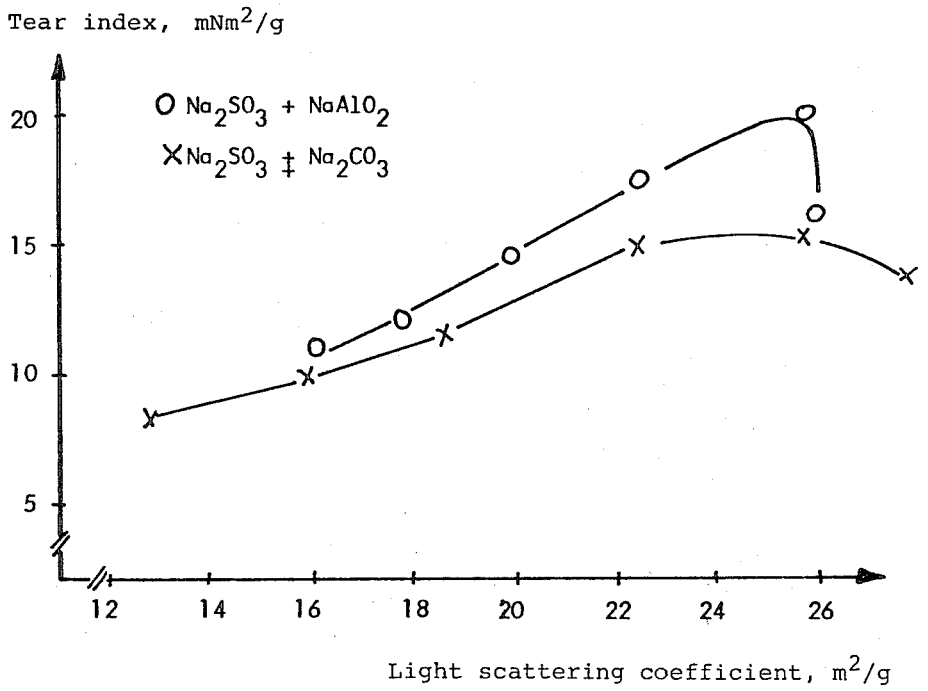

It is an object of the present invention to provide, in accordance with the afore-said process, a pulping method in which sodium sulfite ($Na_2SO_3$) is the base cooking liquor and sodium aluminate ($NaAlO_2$) the buffering agent. Furthermore, to produce chemically defibered pulps a small dosage of anthraquinone must be added. The optimum amount of sodium hydroxide is 4% based on the weight of the wood chips. The initial pH is 10–13.5.

Sodium aluminate has already for some time been used alone as a cooking chemical (U.S. Pat. No. 2,601,110). In connection with this research, too, sodium aluminate cooks with anthraquinone additions have been performed and comparisons with the corresponding soda cookings have been made. According to the results, when using sodium aluminate wood delignifies as well as when cooking with sodium hydroxide, which was expected, since sodium aluminate liquor acts mainly as a source for hydroxide.

Sodium aluminate is used not only as a cooking chemical, but also in disposing of waste liquor and in regenerating the chemicals (U.S. Pat. No. 4,035,228). This patent comprises a Sonoco-rotary kiln-pyrolysis process, in which aluminum hydroxide precipitate is first filtered from the cooking liquor through washing filters and then returned for circulation in the recovery system.

In the process according to the present invention, it has been found that the sodium aluminate ($NaAlO_2$) can retain the cooking pH on a certain level better than other known buffering agents (diagram 1). The above described, so called neutral sulfite cooking has been used as a comparing cook. The dosages of sodium aluminate have varied in the range of from 2 to 8% NaOH on wood, the presupposed optimum dosage being between these limits.

In addition to the stability of the pH of the cook this method offers the following advantages compared to the other, above described processes:

1. The process does not create air pollution by evaporating sulphur or similar compounds.
2. The process does not require a complex recovery boiler-causticizing department-recovering system.
3. The process yields pulps with the highest possible viscosity after cooking.
4. The process allows the best possible strength properties, especially tear resistance.
5. The process yields pulps with strength properties equal to those of sulfate pulps, but with far higher yield.

The following examples further illustrate the invention.

EXAMPLE 1

Neutral sulfite comparative cook 3000 g absolutely dry pine chips (pinus silvestris) screened with slotted screens was set in a 20 l forced circulation digester which was furnaced with indirect heating. A 2 to 6 mm fraction was chosen for the cooking. The air-dry chips were presteamed for 15 minutes. The sodium sulfite solution was made by leading sulfur dioxide into the sodium hydroxide solution until the pH was 11.3. The sodium carbonate solution was made by dissolving solid sodium carbonate into water. The application of sodium sulfite liquor was 20%, of sodium carbonate 4% as NaOH on oven dry wood; in addition 2% of anthraquinone was added as well as enough water to obtain a liquid to wood ratio of 4:1. The temperature was raised from 80° C. to 170° C. in 95 minutes and it was maintained in 170° C. for 250 minutes.

After the pulp had been washed over the night, it was screened, the screened pulp was beaten with a Valley-beater. The paper making properties were determined in different beating stages.

EXAMPLE 2

Sodium sulfite-aluminate cook

Using the same apparatus, raw material and sodium sulfite liquor as in example 1, the digester was fed with 3000 g abs. dry chips in an air-dry condition, 20% of sodium sulfite solution, 4% of sodium aluminate solution as NaOH on oven dry wood, 0,2% of anthraquinone and enough liquid to achieve a liquid to wood ratio of 4:1. The temperature rise and the cooking time were the same as in example 1. Sodium aluminate solution was made by dissolving solid sodium aluminate powder in water and by determining the Na and Al contents from filtered, clear solution with AAS. The Na to Al ratio of the applied solution was determined by potentiometrical titration to pH 11 by means of hydrochloric acid. The pulp was further processed as in example 1.

EXAMPLE 3

Comparative sulfate cook

Using the same apparatus and cellulosic material as mentioned in the previous examples, enough liquid with 30% sulfidity was added to obtain a liquid to wood ratio of 4:1 and an active alkaline dosage of 21% as NaOH on oven dry wood. The temperature rise and the cooking temperature were the same as in the previous examples. The cooking time was 70 minutes and the dosage of anthraquinone 0,25%. The pulp was further processed as in the previous examples.

The test results of the pulps are summarized in the following table and the graphs of paper technical properties in the diagrams 2, 3 and 4.

The comparison between the results of examples 1, 2 and 3 shows that when applying the process according to the present invention for the pulping, the strength properties of the pulp are as good or better than the strength properties of sodium sulfite-carbonate pulp or sulfate pulp made from the same kinds of chips.

TABLE

Properties of pulps with sodium sulfite - aluminate and of comparing sulfite and sulfate pulps

| Cooking solution, % NaOH | | | | Total | Kappa | Viscosity | Refining | SR | Density | Tear. Ind. | Burst. Ind. | Light scattering coeff. | |
|---|---|---|---|---|---|---|---|---|---|---|---|---|---|
| $Na_2SO_3$ | $Na_2CO_3$ | $NaAlO_2$ | AQ | yield, % | No. | CED | time, min | value | | $mNm^2/g$ | $kPam^2/g$ | $m^2/kg$ | Opacity |
| Cook No. N | | | | | | | | | | | | | |
| 20 | 4 | — | 0.2 | 57.4 | 39.3 | 1275 | 0 | 13 | 354 | 13.7 | 1.23 | 27.7 | 97.3 |
| | | | | | | | 5 | 14 | 397 | 15.1 | 4.69 | 25.7 | 88.7 |
| | | | | | | | 15 | 15 | 500 | 14.9 | 5.97 | 22.4 | 87.7 |
| | | | | | | | 30 | 20 | 580 | 11.5 | 5.68 | 18.6 | 83.2 |
| | | | | | | | 45 | 41 | 646 | 9.9 | 7.08 | 15.9 | 81.7 |
| | | | | | | | 60 | 61 | 704 | 8.4 | 7.41 | 12.8 | 78.6 |
| Cook No. A | | | | | | | | | | | | | |
| 20 | — | 4 | 0.2 | 55.3 | 40.7 | 1478 | 0 | 11 | 394 | 15.9 | 1.17 | 25.9 | 98.5 |
| | | | | | | | 5 | 12 | 430 | 20.0 | 2.53 | 25.7 | 94.2 |
| | | | | | | | 15 | 13 | 506 | 17.3 | 4.03 | 22.4 | 92.3 |
| | | | | | | | 30 | 17 | 591 | 14.4 | 6.01 | 19.9 | 91.1 |
| | | | | | | | 45 | 31 | 643 | 11.9 | 6.92 | 17.8 | 90.1 |
| | | | | | | | 60 | 57 | 658 | 11.0 | 7.22 | 16.1 | 88.0 |
| Cook No. S | | | | | | | | | | | | | |
| Sulfidity | Active alkali | | | | | | | | | | | | |
| % | % | | | | | | | | | | | | |
| 30 | 21 | — | 0.25 | 48.1 | 32.3 | 1125 | 0 | 14 | 533 | 16.1 | 2.21 | — | — |
| | | | | | | | 15 | 18 | 639 | 15.3 | 6.58 | — | — |
| | | | | | | | 30 | 24 | 677 | 13.3 | 8.05 | — | — |
| | | | | | | | 45 | 32 | 702 | 12.1 | 8.81 | — | — |

TABLE-continued

Properties of pulps with sodium sulfite - aluminate and of comparing sulfite and sulfate pulps

| Cooking solution, % NaOH | | | | Total | Kappa | Viscosity | Refining | SR | Density | Tear. Ind. | Burst. Ind. | Light scattering coeff. | |
|---|---|---|---|---|---|---|---|---|---|---|---|---|---|
| $Na_2SO_3$ | $Na_2CO_3$ | $NaAlO_2$ | AQ | yield, % | No. | CED | time, min | value | | $mNm^2/g$ | $kPam^2/g$ | $m^2/kg$ | Opacity |
| | | | | | | | 60 | 44 | 724 | 11.4 | 9.20 | — | — |

We claim:

1. An alkaline pulping process for chips of lignocellulosic material which comprises cooking said lignocellulosic material at 140°–210° C. for 250 minutes with a solution containing sodium sulfite at a pH of 10–13.5 in the presence of sodium aluminate as a buffering agent in the amount of 2% to 8% as NaOH based on the dry weight of the chips of lignocellulosic material, and 0.2% anthraquinone, wherein said cooking is carried out to produce a pulp of high viscosity, high strength and good yield.

2. A process according to claim 1, wherein the amount of sodium aluminate as NaOH is about 4% of the dry weight of chips.

* * * * *